United States Patent [19]

Makita

[11] Patent Number: 4,459,544

[45] Date of Patent: Jul. 10, 1984

[54] DEVICE FOR DETECTING ACTUAL IGNITION IN A SIMULTANEOUS IGNITION ENGINE

[75] Inventor: Hiromitsu Makita, Yokohama, Japan

[73] Assignee: Alps Electric Co., Ltd., Tokyo, Japan

[21] Appl. No.: 431,237

[22] Filed: Sep. 30, 1982

[30] Foreign Application Priority Data

Dec. 29, 1981 [JP] Japan ..... 56-212503

[51] Int. Cl.[3] ..... F02P 17/00

[52] U.S. Cl. ..... 324/391

[58] Field of Search ..... 324/392, 391, 378, 379; 307/234; 73/117.2

[56] References Cited

U.S. PATENT DOCUMENTS

| | | | |
|---|---|---|---|
| 4,312,043 | 1/1982 | Frank | 324/391 |
| 4,319,481 | 3/1982 | Yelke | 73/119 A |
| 4,366,436 | 12/1982 | Everett | 324/379 |
| 4,379,263 | 4/1983 | Everett | 324/379 |
| 4,396,888 | 8/1983 | Everett | 324/379 |

FOREIGN PATENT DOCUMENTS

| | | | |
|---|---|---|---|
| 144625 | 2/1960 | U.S.S.R. | 324/391 |

OTHER PUBLICATIONS

Hoyt: "All Electronic Ignition"–Popular Science, Oct., 83, pp. 72–73.

*Primary Examiner*—Stanley T. Krawczewicz
*Assistant Examiner*—Jose M. Solis
*Attorney, Agent, or Firm*—Guy W. Shoup; Gerard F. Dunne

[57] ABSTRACT

An actual ignition timing detecting device for use with a simultaneous ignition engine in which two cylinders are actually ignited in an alternate manner by simultaneously applying an ignition pulses generated in inverse polarities between the two terminals of an ignition coil. The actual ignition timing of the two cylinders can be detected from the rise and fall of a pulse signal, which rises at the misfire timing and falls at the actual ignition timing, by detecting the ignition pulses of one of the cylinders and by forming that pulse signal at all times in accordance with the difference in waveform between the actual ignition and misfire pulses of the ignition pulses detected.

1 Claim, 8 Drawing Figures

DEVICE FOR DETECTING ACTUAL IGNITION IN A SIMULTANEOUS IGNITION ENGINE

BACKGROUND OF THE INVENTION

1. Field of the Invention

The present invention relates to a simultaneous ignition system for an automobile and, more particularly, to an actual ignition timing detecting device for use with the simultaneous ignition system.

2. Description of the Prior Art

One of the important factors for determining the performance of an engine is the timing for the ignition timing of each cylinder. In order that the engine may operate efficiently, the explosive force of the combustion of the fuel has to be concentrated as it is transmitted to the piston. For this purpose, ignition of the fuel generally is intended to take place as the piston moves to its position closest to the corresponding ignition plug so that the fuel is sufficiently compressed. As a practical matter, however, the ignition is often conducted immediately before or after the piston moves to its position closest to the ignition plug, as a consequence of the period from the ignition time to the time of actual combustion of the fuel, the regulation of the exhaust emission control or the like. In either event, nevertheless, the ignition timing has to be strictly set.

In the case of the maintenance of an automobile, therefore, in which the engine is to be adjusted, the ignition timing is adjusted. For this purpose, the ignition timing has to be detected.

Before entering into the description of the preferred embodiment, the prior art will be described in more detail with reference to the accompanying drawings.

FIG. 1 is a circuit diagram showing one example of an ignition system according to the prior art. Reference numeral 1 indicates a power source; numeral 2 an ignition coil; numeral 3 a contact point; numeral 4 a capacitor; numeral 5 a distributor; numeral 6 the ignition plug of a first cylinder; and numeral 7 the ignition plug of a second cylinder.

FIG. 2 is a waveform chart illustrating the ignition pulses which are to be applied to the respective ignition plugs shown in FIG. 1. These ignition pulses are indicated at such reference letters as correspond to those of FIG. 1.

In this ignition system of the prior art, when the contact point 3 is repetively opened and closed, the capacitor 4 charges and discharges the current coming from the power source 1 so that positive pulses are generated at the primary coil $L_1$ of the ignition coil 2 in response to those charging and discharging operations. The secondary coil $L_2$ of the ignition coil 2 has a sufficiently larger number of such windings than the primary coil $L_1$ and they are turned in the opposite direction. As a result, the secondary coil $L_2$ generates higher voltage negative pulses by induction from the positive pulses generated at the primary coil $L_1$. These high pulses generated by the secondary coil $L_2$ are applied to the distributor 5 by which they are alternately distributed to the ignition plugs 6 and 7. One train of the pulses thus distributed is applied as the ignition pulses (a) of the first cylinder (although not shown) to the ignition plug 6, whereas the other train is applied as the ignition pulses (b) of the second cylinder (although not shown) to the ignition plug 7 so that the first and second cylinders are alternately ignited.

In the case of the engine equipped with the ignition system thus far described, in order to detect the ignition timing of the respective cylinders, it is sufficient to directly detect the ignition pulses (a) and (b) by means of a sensor.

Another form of two-cylinder engine is the so-called "simultaneous ignition engine" which is equipped with an ignition system of a construction simplified by omitting the distributor.

FIG. 3 is a circuit diagram which shows the above-specified ignition system and in which the parts corresponding to those of FIG. 1 are indicated by identical reference characters. FIG. 4 is a waveform chart which illustrates the ignition pulses of the ignition system of FIG. 3 and in which the respective pulses are indicated at reference letters corresponding to those of FIG. 3.

In this ignition system, the secondary coil $L_2$ of the ignition coil 2 is grounded through the ignition plugs 6 and 7 so that the pulses generated between both its terminals are applied as the ignition pulses to the ignition plugs 6 and 7. As a result, the ignition plug 6 of the first cylinder is supplied with the positive ignition pulses (a), whereas the ignition plug 7 of the second cylinder is supplied with the negative ignition pulses (b).

Here, in the simultaneous ignition engine equipped with the ignition system shown in FIG. 3, while one cylinder is in a fuel-compressed stroke, the other cylinder is in an exhaust stroke. Even if the cylinders have their respective ignition plugs 6 and 7 simultaneously supplied with the ignition pulses, therefore, the one cylinder in the fuel-compressed state is actually ignited (which state will be shortly be referred to as the "actual ignition"), whereas the other cylinder in the exhaust state is not ignited (which state will be shortly referred to as the "misfire").

Thus, the first and second cylinders alternately repeat the actual ignition and the misfire when they are supplied with the ignition pulse so that when one of them is actually ignited the other is misfired.

Consequently, when the ignition pulses (a) and (b) are applied to the ignition plugs 6 and 7 of the first and second cylinders, one train of alternate pulses $a_1$ of the ignition pulses (a) will ensure the actual ignition, and the other train of alternate pulses $a_2$ of the same will invite the misfire. Likewise, one train of alternate pulses $b_1$ of the other ignition pulses (b) will ensure the actual ignition, and the other train of alternate pulses $b_2$ of the same will invite the misfire. As has been described with reference to FIG. 1, therefore, even if the respective ignition pulses (a) and (b) are detected, the pulses indicative of the timing of the misfire (which pulses will be shortly referred to as the "misfire pulses") are detected in addition to the pulses indicative of the timing of the actual ignition (which pulses will be shortly referred to as the "actual ignition pulses"), thus making it difficult to detect the actual ignition timings of the respective cylinders by conventional techniques.

SUMMARY OF THE INVENTION

It is, therefore, an object of the present invention to provide an actual ignition timing detecting device for use with an automotive simultaneous ignition system, which device is freed from the aforementioned defect of the prior art.

Another but still major object of the present invention is to provide an actual ignition timing device which is enabled to detect the actual ignition timings of the respective cylinders of the simultaneous ignition engine by making use of the ignition pulses of one of the cylinders.

In order to achieve those objects, the present invention is characterized in that the actual ignition timing of respective cylinders can be detected from the rise and fall of a pulse signal, which rises at the misfire timing and falls at the actual ignition timing, by detecting the ignition pulses of one cylinder and by forming that pulse signal at all times in accordance with the difference in waveform between the actual ignition and misfire pulses of the ignition pulses detected.

According to a feature of the present invention, there is provided an actual ignition timing detecting device for use with a simultaneous ignition engine having two cylinders actually ignited in an alternate manner by simultaneously applying such ignition pulses as are generated in inverse polarities between the two terminals of an ignition. The actual ignition timing detecting device comprises first means for detecting the ignition pulses, which are applied to one of said cylinders, to generate a first pulse signal; second means for generating second and third pulse signals which are inverted at the respective leading edges of said first pulse signal to have different polarities; third means made responsive to said second and third pulse signals for generating fourth and fifth pulse signals which are composed of respective trains of alternate pulses of said first pulse signal; and fourth means made responsive to said fourth and fifth pulse signals for selecting either said second or third pulse signal, whereby the output signal of said fourth means is enabled to have a predetermined phase with respect to the misfire timing of said one cylinder.

BRIEF DESCRIPTION OF THE DRAWINGS

Other objects and advantages of the present invention will become apparent from the following description taken with reference to the accompanying drawings, in which.

DESCRIPTION OF THE PREFERRED EMBODIMENT

The present invention will be described in detail in connection with one embodiment thereof with reference to the accompanying drawings.

Figure 5:
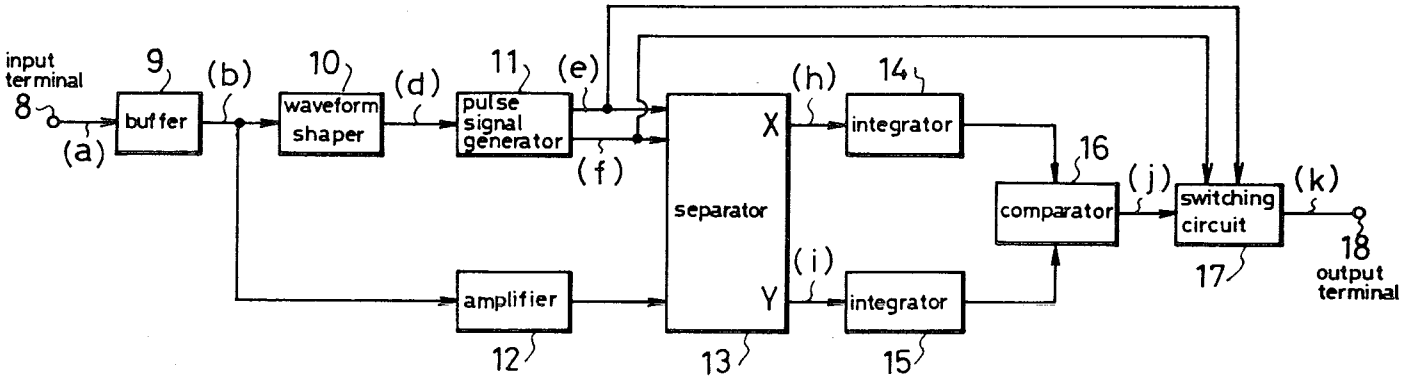
FIG. 5 is a block diagram showing one embodiment of the actual ignition timing detecting device according to the present invention.

FIG. 5 is a block diagram showing the embodiment of the device according to the present invention for detecting the actual timing for ignition of a simultaneous ignition engine. Reference numeral 8 indicates an input terminal; numeral 9 a buffer; numeral 10 a waveform shaper; numeral 11 a pulse signal generator; numeral 12 an amplifier; numeral 13 a separator; numerals 14 and 15 integrators; numeral 16 a comparator; numeral 17 a switching circuit; and numeral 18 an output terminal.

Figure 6:
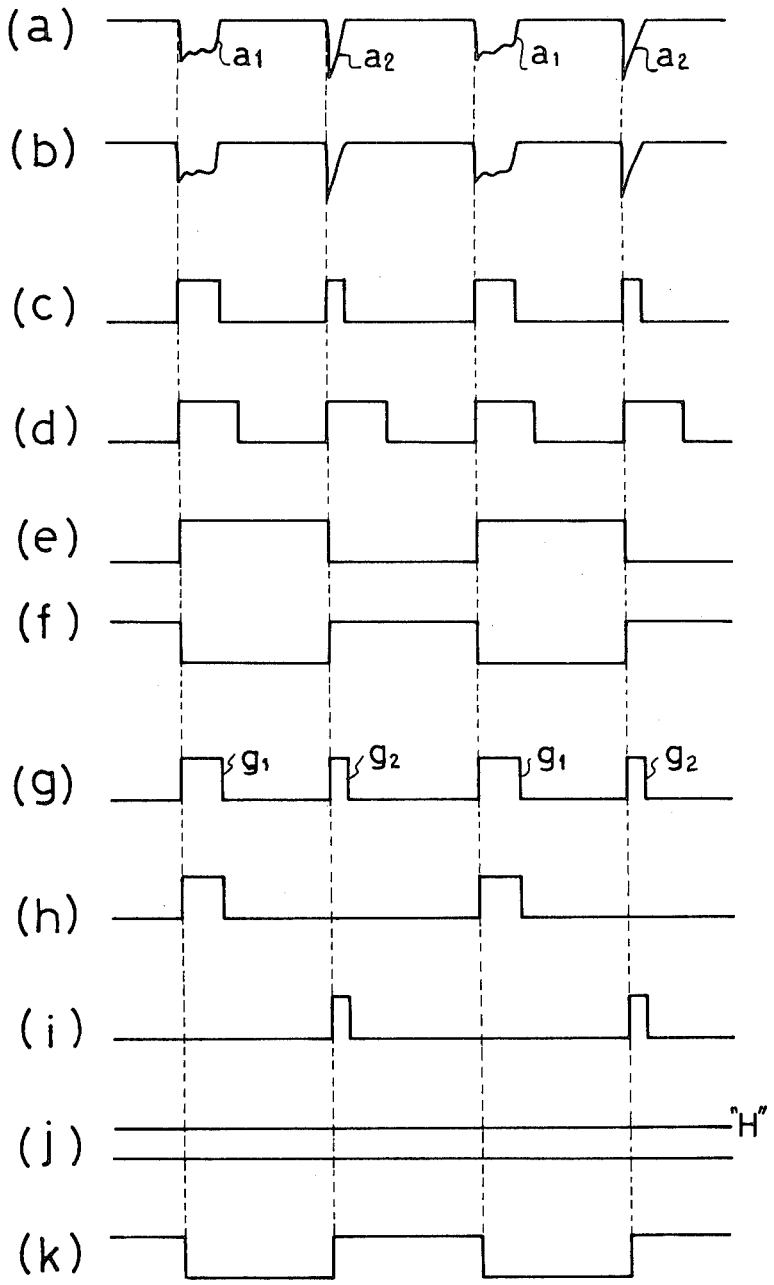
FIG. 6 is a time chart illustrating one example of the timings of the signals of the respective parts of FIG. 5.

FIG. 6 is a timing chart which illustrates the timing of the signals at the respective points of FIG. 5 and in which the respective signals are indicated at reference letters corresponding to those of FIG. 5.

The operations of the present embodiment will be described in the following.

Figure 3:
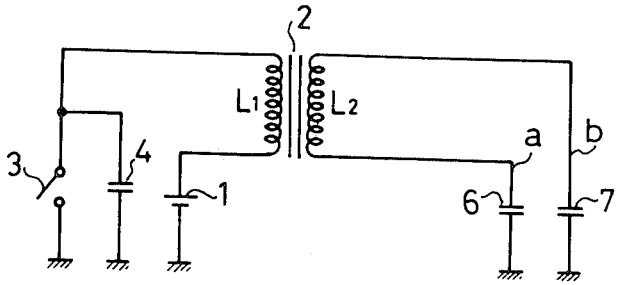
Fig.3 PRIOR ART
FIG. 3 is a circuit diagram showing another example of the engine ignition system of the prior art.
Figure 4:
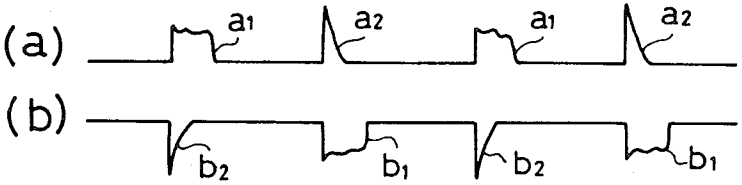
Fig. 4 PRIOR ART
FIG. 4 is a waveform chart illustrating the ignition pulses of the respective cylinders of FIG. 3.

In FIGS. 5 and 6, a sensor (although not shown) detects the ignition pulses which are applied to the ignition plug 7 (as has been shown in FIG. 3) of the second cylinder, so that the pulse signal (a) corresponds to the signal (b) of FIG. 4 and is supplied from the input terminal 8 to the buffer 9.

Here, the ignition plug is equipped with both an electrode connected with the ignition coil and a grounded electrode so that it effects a discharge between its electrodes when it is supplied with an ignition pulse, thereby to generate a spark. When the fuel is burned by that spark, a current flows between the aforementioned two electrodes during the ignition pulse period by the existence of the ions between the electrodes so that the actual ignition pulses $b_1$ (as have been illustrated in FIG. 4) have their pulse width enlarged. When the ignition pulses are applied during the exhaust stroke, on the contrary, a capacitance is produced between the aforementioned electrodes so that the misfire pulses $b_2$ (as have been illustrated in FIG. 4) have a small width. As a result, the pulse signal (a) supplied from the input terminal 8 is a pulse signal in which the wider actual ignition pulses $b_1$ of FIG. 4 and the narrower misfire pulses $b_2$ of FIG. 4 are alternately repeated.

This pulse signal (a) of FIG. 5 is processed by the buffer 9 into the pulse signal (b), which is applied to the waveform shaper 10 and the amplifier 12.

The waveform shaper 10 shapes the pulse signal (b) into a positive pulse signal (d) having a constant width rising at each beginning of the pulses of the former, and applies it to the pulse signal generator 11.

This pulse signal generator 11 is triggered at each rise of the pulses of the pulse signal (d) thereby to generate pulse signals (e) and (f) of different polarities, which are inverted at each rise of the pulse signal (d). The pulse signals (e) and (f) thus generated are applied to the separator 13 and the switching circuit 17.

On the other hand, the pulse signal (b) from the buffer 9 is applied to the amplifier 12.

This amplifier 12 has saturation characteristics serving to invert the polarities of the pulse signal (b) and to be saturated upon reception of each pulse. As a result, a pulse signal (g) having a constant amplitude but a width dependent upon the width of the signal (b) is extracted from the amplifier 12.

Thus, that pulse signal (g) is supplied to the separator 13 so that it is separated into the wider pulses $g_1$ and the narrower pulses $g_2$ in response to the pulse signals (e) and (f) which are simultaneously supplied from the pulse signal generator 11.

More specifically, when the pulse signal (e) is at a high level and the pulse signal (f) is at a low level, the signal (g) is supplied to an X terminal of the separator 13 so that the wider pulses $g_1$ are generated at the X terminal. Next, when the pulse signal (e) takes the low level and the pulse signal (f) takes the high level, the signal (g) is supplied to a Y terminal so that the narrower pulses $g_2$ are generated at the Y terminal. Thus, since the rising and falling of the pulse signals (e) and (f) are coincident with the rising of the pulse signal (g), a pulse signal (h) composed of the wider pulses is extracted from the X terminal whereas a pulse signal (i) composed of the narrower pulses is extracted from the Y terminal of the separator 13.

Next, those pulse signals (h) and (i) are respectively integrated by the integrators 14 and 15 so that they are converted into the d.c. voltages corresponding to their respective pulse widthes, and they are applied to the comparator 16 so that they may have their levels compared.

The switching circuit 17 selects the pulse signal (f) coming from the pulse signal generator 11, when the output signal (j) of the comparator 16 is at the high level, and the pulse signal (e) when the output signal (j) is at the low level. Here, since the pulse width of the pulse signal (h) is wider and the pulse width of the pulse signal (i) is narrower, as has been described hereinbefore, the d.c. voltage produced by the integrator 14 is higher than that produced by the integrator 15, and the output signal (j) of the compactor 16 takes the high level "H" so that the switching circuit 17 selects the signal (f). As a result, a pulse signal (k) to be extracted from the switching circuit 17 indicates the misfire timing of the second cylinder by its rise and the ignition timing of the same by its fall. This means that the rise of the pulse signal (k) indicates the actual ignition timing of the first cylinder.

By supplying the signal (k) from the output terminal 18 to a predetermined processor, therefore, the actual ignition timing of the first and second cylinders can be detected from the rise and fall of the signal (k).

The foregoing description is directed to the case in which the rise of the pulse signal (e) (accordingly, the fall of the pulse signal (f)) is coincident with the rise of the wider pulses $g_1$ of the pulse signal (g). However, the pulse signal generator 11 may include the case in which the fall of the pulse signal (e) (accordingly, the rise of the pulse signal (f)) is coincident with the rise of the wider pulses $g_1$ of the pulse signal (g), as contrary to the former case. This is because there may be the case in which the signal (e) from the pulse signal generator 11 rises whereas the signal (f) falls, and a case, in which the signal (e) falls whereas the signal (f) rises, by the pulses which correspond to the actual ignition timing of the signal (d).

Even if the fall of the pulse signal (e) and the rise of the wider pulses $g_1$ of the pulse signal (g) become coincident with each other, however, there is also extracted from the output terminal 18 the signal which has its rise and fall timings coinciding with the misfire and actual ignition timings of the second cylinder, respectively.

Figure 7:
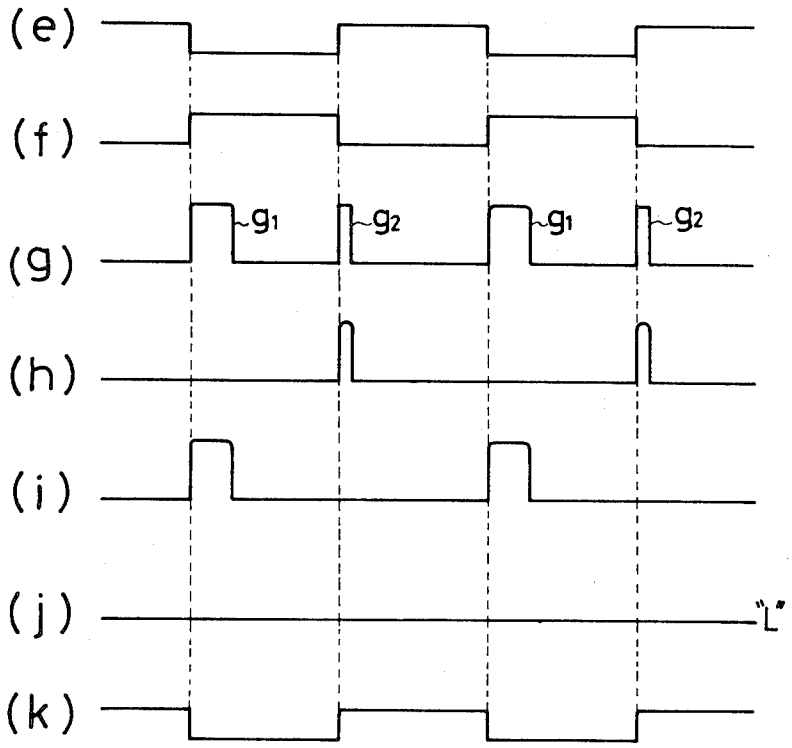
FIG. 7 is a timing chart illustrating another example of the timings of the signals of the respective parts of FIG. 5.

FIG. 7 is a time chart showing the timing of the signals at the respective points in the circuit of FIG. 5 in case the timing at which the signal (e) fall and the signal (f) rises are coincident with the rise of the wider pulses $g_1$ of the signal (g). In FIG. 7, the respective signals are indicated by reference letters corresponding to those of FIG. 5.

In FIGS. 5 and 7, the signals (e), (f) and (g) are supplied to the separator 13. As has been described hereinbefore, however, when the pulse signal (e) is at the low level and the signal (f) is at the high level, the signal (g) is supplied to the Y terminal of the separator 13 so that the wider pulses $g_1$ are generated at the Y terminal. When the pulse signal (e) is at the high level and the pulse signal (f) is at the low level, on the other hand, the signal (g) is supplied to the X terminal so that the narrower pulses $g_2$ are generated at the X terminal. As a result, the pulse signal (h) is composed of the narrower pulses $g_2$ whereas the pulse signal (i) is composed of the wider pulses $g_1$.

Thus, the output signal (j) of the comparator 16 takes the low level "L" so that the switching circuit 17 selects the pulse signal (e) to control its operation. As a result, there is extracted from the output terminal 18 the pulse signal (k) which has its rise and fall coinciding with the misfire and actual ignition timings of the second cylinder, respectively.

Figure 1:
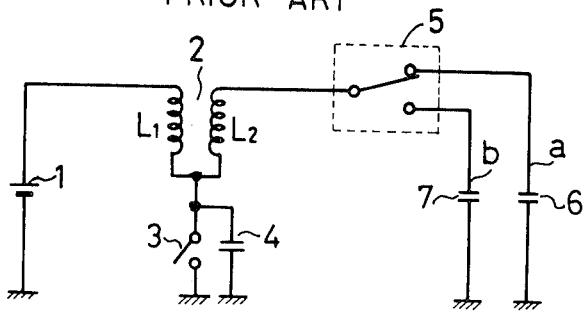
Fig.1 PRIOR ART
FIG. 1 is a circuit diagram showing one example of the engine ignition system according to the prior art.
Figure 2:
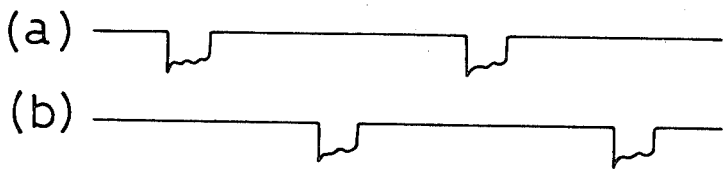
Fig.2 PRIOR ART
FIG. 2 is a waveform chart illustrating the ignition pulses of the respective cylinders of FIG. 2.

By detecting the ignition pulses of the second cylinder in the manner thus far described, therefore, the actual ignition timing of the first and second cylinders can be accurately detected. Since the ignition pulses of the second cylinder are negative pulses (as indicated at (b) in FIG. 4), on the other hand, the sensor for detecting ignition pulses need not be specially constructed but can use the conventional sensor which is employed to detect the negative ignition pulses as indicated at (a) and (b) of the ignition system which is shown in FIG. 1.

Figure 8:
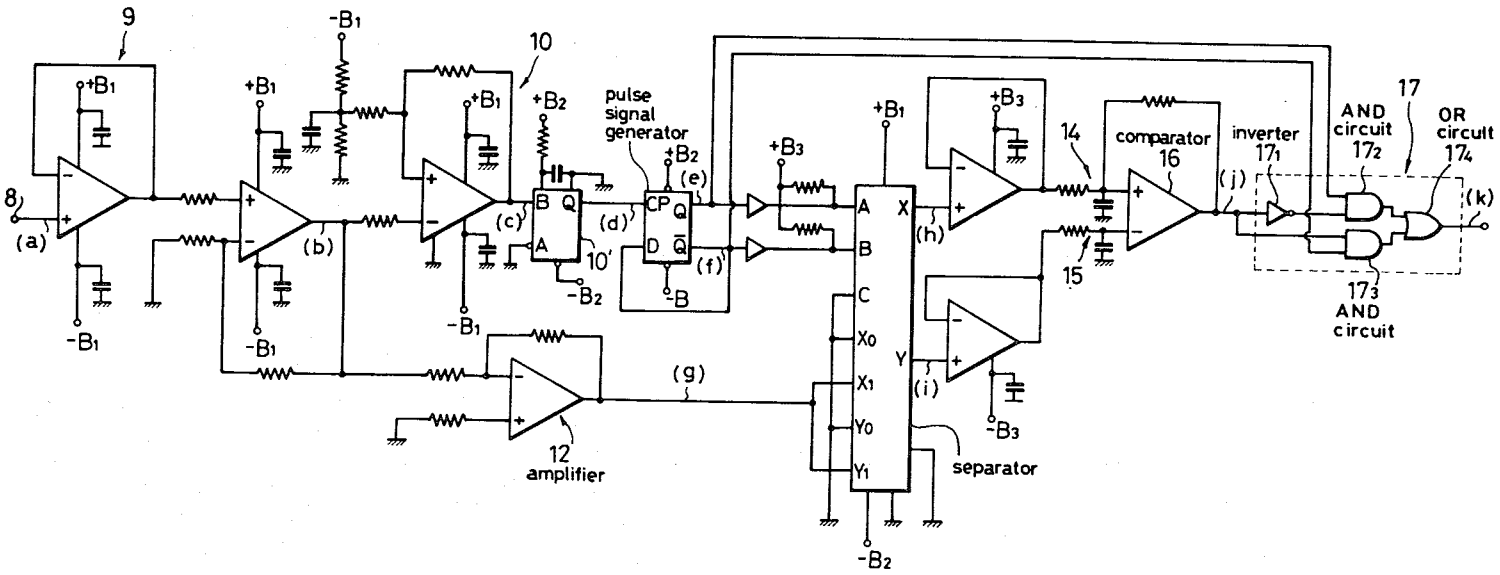
FIG. 8 is a circuit diagram showing one specified example of FIG. 5.

FIG. 8 is a circuit diagram which shows one specific example of FIG. 5 and in which parts corresponding to those of FIG. 5 are indicated at identical reference characters.

In FIG. 8, the pulse signal (a) coming from the input terminal 8 is processed into the pulse signal (b) by the action of the buffer 9.

The pulse signal (b) is supplied to the waveform shaper 10 so that it is first clipped into the positive pulse signal (c) having the predetermined amplitude (as has been illustrated in FIG. 6). Next, the monostable multivibrator 10 is triggered by the rise of the pulse signal (c) thereby to generate the pulse signal (d) having the predetermined pulse width.

The pulse signal (d) is supplied to the pulse signal generator 11. This pulse signal generator 11 is constructed of a D-flip-flop circuit (which will be shortly referred to as "D-FF") and has its clock terminal CP supplied with the pulse signal (d) thereby to generate the signals (e) and (f) at its Q and $\overline{Q}$ terminals, respectively. Moreover, the pulse signal generator 11 has its data terminal D supplied with the signal (f).

Here, since the Q and $\overline{Q}$ terminals of the D-FF 11 have their levels inverted, their levels are inverted in response to each pulse of the pulse signal (d). As a result, there can be generated at the Q and $\overline{Q}$ terminals either the pulse signal (e) or (f) which is illustrated in FIG. 6 or 7.

These pulse signals (e) and (f) are respectively supplied not only to the switching circuit 17 but also the separator 13. This separator 13 is constructed of a data multiplexer (which will be shortly referred to as "DM") and has its input terminals A and B supplied with the pulse signal (e) and the signal (f), respectively, and its input terminal C grounded. The separator 13 has its other terminals $X_0$ and $Y_0$ grounded and its terminals $X_1$ and $Y_1$ supplied with the pulse signal (g) coming from the amplifier 12.

Now, an address signal is generated in response to the signals which are supplied to the terminals A, B and C. In response to that address signal, one of the signals supplied to the terminals $X_0$ and $X_1$ is selected and supplied to the output terminal X, and one of the signals supplied to the terminals $Y_0$ and $Y_1$ is selected and supplied to the output terminal Y.

The relationships in those selections are tabulated in Table 1:

TABLE 1

| Level at Terminal A | Leval at Terminal B | Level at Terminal C | Terminal of Signal to Terminal X | Terminal of Signal to Terminal Y |
|---|---|---|---|---|
| High | Low | Low | $X_1$ | $Y_0$ |
| Low | High | Low | $X_0$ | $Y_1$ |

As shown in FIG. 6, therefore, the time the pulse signal (e) rises and the pulse signal (f) falls in coincident with the rise of the wider pulses $g_1$ of the pulse signal (g), and the pulse signal (g) to be supplied to the terminal $X_1$ is supplied to the terminal X during the period for which the pulse signal (e) is at the high level whereas the pulse signal (f) is at the low level. During the period for which the pulse signal (e) is at the low level whereas the pulse signal (f) is at the high level, on the contrary, the pulse signal to be supplied to the terminal $Y_1$ is supplied to the terminal Y. As a result, the pulse signal (h) composed of the wider pulses is extracted from the terminal X whereas the pulse signal (i) composed of the narrower pulses is extracted from the terminal Y.

Moreover, those pulse signals (h) and (i) thus extracted are supplied through the buffer to the integrators 14 and 15.

The output signal of integrator 14 is supplied to the positive terminal of the comparator 16 whereas the output signal of the integrator 15 is supplied to the negative terminal of the comparator 16. As a result, the output signal (j) of the comparator 16 takes the high level "H".

The switching circuit 17 is constructed of an inverter $17_1$, AND circuits $17_2$ and $17_3$ and an OR circuit $17_4$. The output signal (j) of the comparator 16 is inverted by the coactions of the AND circuit $17_3$ and the inverter $17_1$ and is supplied to the AND circuit $17_2$, whereas the signals (e) and (f) coming from the pulse signal generator 11 are supplied to the AND circuits $17_2$ and $17_3$, respectively. The output signals of the AND circuits $17_2$ and $17_3$ are supplied to the OR circuit $17_4$, the output signal of which is extracted as the desired pulse signal (k) from the output terminal 18.

Therefore, when the output signal (j) coming from the comparator 16 takes such a high level as has been described hereinbefore, the pulse signal (f) passes through the AND circuit $17_3$ so that the output signal (k) is generated through the OR circuit $17_4$.

As illustrated in FIG. 7, on the contrary, when pulse signal (e) rises and the pulse signal (f) falls is coincident with the rise of the wider pulses $g_1$ of the pulse signal (g), the pulse signal (h) is a pulse signal composed of the narrower pulses whereas the pulse signal (i) is a pulse signal composed of the wider pulses, as has been described hereinbefore.

Thus, those pulse signals (h) and (i) are integrated by the integrators 14 and 15 and are respectively supplied to the comparator 16. Then, the output signal (j) of the comparator 16 takes the low level and is inverted by the inverter $17_1$ thereby to open the AND circuit $17_2$ so that the pulse signal (e) is extracted as the output signal (k) from the output terminal 18.

Of those pulse signals (e) and (f), as has been described hereinbefore, the pulse signal (e) which rises at the rise of the narrower pulses $g_2$ of the pulse signal (g) and falls at the rise of the wider pulses $g_1$ is selected and is extracted from the output terminal 18.

Incidentally, it is apparent that FIG. 8 merely shows the specific circuit of FIG. 5 and that the respective circuits of FIG. 5 can be replaced by other circuits having the identical functions.

As has been described hereinbefore, according to the present invention, the ignition pulses of one cylinder of the simultaneous ignition engine are detected as a first pulse signal to generate second and third pulse signals having different polarities and inverted in response to each pulse of the first pulse signal. A pulse signal having its rise coinciding with the pulses of the second and third pulse signals has a pulse corresponding to each misfire of the one cylinder and each actual ignition. The actual ignition timing of each cylinder can thus be detected from the rise and fall of the first pulse signal selected. As a result, it is possible to provide an actual ignition timing detecting device which is enabled to accurately detect the actual ignition timing of each cylinder even if the ignition pulses to be detected contain pulses indicative of the misfire timing, and which can enjoy an excellent function while eliminating the defect associated with the prior art.

What is claimed is:

1. For use with an engine having two cylinders receiving ignition pulses simultaneously but actually ignited in an alternative manner by simultaneously applying ignition pulses generated in inverse polarities between the two terminals of an ignition coil of the engine, a device for detecting the timing of actual ignition of the cylinders of the engine, comprising: first means of detecting the ignition pulses applied to one of said cylinders to generate a first pulse signal; second means for generating second and third pulse signals inverted at the respective leading edges of said first pulse signal to have different polarities; third means made responsive to said second and third pulse signals for generating fourth and fifth pulse signals composed of respective trains of alternate pulses of said first pulse signal; and fourth means made responsive to said fourth and fifth pulse signals for selecting either said second or third pulse signal to, enable the output of said fourth means so that it will have a predetermined phase with respect to the misfire timing of said one cylinder.

* * * * *